United States Patent [19]

Carignan

[11] Patent Number: 4,717,333

[45] Date of Patent: Jan. 5, 1988

[54] BURNER IGNITION SYSTEM

[75] Inventor: Forest J. Carignan, Bedford, Mass.

[73] Assignee: Advanced Mechanical Technology, Inc., Newton, Mass.

[21] Appl. No.: 820,450

[22] Filed: Jan. 17, 1986

Related U.S. Application Data

[62] Division of Ser. No. 459,787, Jan. 21, 1983, Pat. No. 4,565,519.

[51] Int. Cl.[4] ..... F23Q 9/08

[52] U.S. Cl. ..... 431/44; 431/42; 431/51; 431/58; 431/69; 431/90

[58] Field of Search ..... 431/42, 43, 44, 51, 431/52, 53, 54, 58, 69, 89, 90; 137/65, 66

[56] References Cited

U.S. PATENT DOCUMENTS

| | | | |
|---|---|---|---|
| 3,174,533 | 3/1965 | Weber | 431/44 |
| 3,174,534 | 3/1965 | Weber | 431/44 |
| 4,131,413 | 12/1978 | Ryno | 431/44 |

*Primary Examiner*—Margaret A. Focarino

*Attorney, Agent, or Firm*—Hamilton, Brook, Smith & Reynolds

[57] ABSTRACT

An electronic ignition system for a gas burner is battery operated. The battery voltage is applied through a DC-DC chopper to a step-up transformer to charge a capacitor which provides the ignition spark. The step-up transformer has a significant leakage reactance in order to limit current flow from the battery during initial charging of the capacitor. A tank circuit at the input of the transformer returns magnetizing current resulting from the leakage reactance to the primary in succeeding cycles. An SCR in the output circuit is gated through a voltage divider which senses current flow through a flame. Once the flame is sensed, further sparks are precluded. The same flame sensor enables a thermopile driven main valve actuating circuit. A safety valve in series with the main gas valve responds to a control pressure thermostatically applied through a diaphragm. The valve closes after a predetermined delay determined by a time delay orifice if the pilot gas is not ignited.

9 Claims, 2 Drawing Figures

BURNER IGNITION SYSTEM

This application is a division of application Ser. No. 459,787 filed Jan. 21, 1983, now U.S. Pat. No. 4,565,519.

DESCRIPTION

1. Field of the Invention

This invention relates to ignition systems for gas burners and in particular to electronic ignition systems which operate from electrical storage batteries.

2. Background

Conventional gas burners include a pilot flame which continuously burns a small amount of gas adjacent to a main burner. When a thermostatically controlled valve opens, a significantly larger gas flow is introduced into the burner and that gas is ignited by the pilot flame. The gas which is burned by the pilot flame during standby is wasted energy.

In recent years, a number of electronic ignitions have been introduced. Such ignitions may ignite a main flame directly with an electrical spark. Generally, however, the electrical spark ignites a pilot flame and that pilot flame in turn ignites the main gas flow. This latter approach is preferred because only a small amount of gas is introduced into the combustion chamber during the ignition process; therefore, if the pilot fails to ignite, a substantial amount of unburned gas is not introduced into the combustion chamber. If the pilot fails to ignite after some predetermined time, the pilot gas is also valved off to avoid a buildup of unburned gas in the combustion chamber.

In order that the electrically ignited gas burners can operate stand-alone units without the need for a connection to line voltage, attempts have been made to use electrical storage batteries as the power supplies to the ignition circuits. Examples of such systems can be found in U.S. Pat. Nos. 3,174,534 and 3,174,535 to Weber and in 4,131,413 to Ryno. The Weber patents suggest applying the battery power through an oscillation circuit across a transformer which supplies power to a spark gap. The battery is recharged after ignition by a thermopile charger which receives energy from the flame. The Ryno patent similarly uses a battery supply which is recharged by a thermopile. It further includes a safety valve for closing gas flow to the pilot nozzle if the pilot gas fails to ignite after a predetermined time.

The use of rechargeable batteries recharged by thermopiles was important because gas burners are relatively maintenance-free over a lifetime of 11 years or more. Periodic replacement of batteries would be an inconvenience which would greatly detract from the use of such systems. However, the recharging circuit and rechargeable battery greatly increase the cost and complexity of the system. In addition, rechargeable batteries have a life expectancy of only about five years.

DISCLOSURE OF THE INVENTION

In accordance with the present invention, a long life battery such as a lithium battery is used. The current drain from that battery is held to a minimum in order that the battery will have a useful life of about 11 years without replacement or recharging. To minimize the current drain from the battery, the igniter circuit includes a step-up transformer which has a significant leakage reactance. That leakage reactance presents the large current drain which would usually result when the transformer output initially begins to charge a capacitor. Such a condition would appear to be a short circuit to the input circuit. To regain much of the reactive leakage energy which would otherwise be returned to the input circuit as the transformer relaxes, a capacitor is placed in parallel with the transformer primary. This resultant tank circuit stores and circulates the magnetizing current for the transformer and applies it to the transformer in a subsequent cycle.

To further minimize current drain from the battery supply, the iginition circuit is disabled once a pilot flame is sensed. Preferably, the ignition pulse is gated to the output through a voltage divider circuit which is in series with the flame. With current draw through the flame a sufficiently high gating voltage is not obtained. This same voltage divider can be used to enable a main valve circuit which is energized by a thermopile.

As a safety feature, the ignition circuit is disabled and the gas flow to the system is closed in the event that the flame fails to ignite after a predetermined amount of time. To avoid power drain from the battery supply, the delay and turnoff of the system are provided by a gas actuated valve which responds only to a thermostatically controlled valve and gas pressures. That valve includes a gas input chamber and a gas output chamber with a normally closed valve element therebetween. The pressure across that valve element acts to open the valve but the pressure differential across a control element between the input chamber and a control chamber acts to hold the valve closed. When a thermostatically controlled valve is opened, line pressure is applied through a diaphragm to the control chamber to allow the safety valve to be opened. After a predetermined amount of time, the pressure in the control volume is reduced by bleedoff to the main gas line downstream of the control valve. If the pilot fails to ignite, the main valve is not turned on and the control volume drops to a sufficiently low pressure that the safety valve is automatically closed.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrated the principles of the invention.

DESCRIPTION OF A PREFERRED EMBODIMENT

Figure 1:
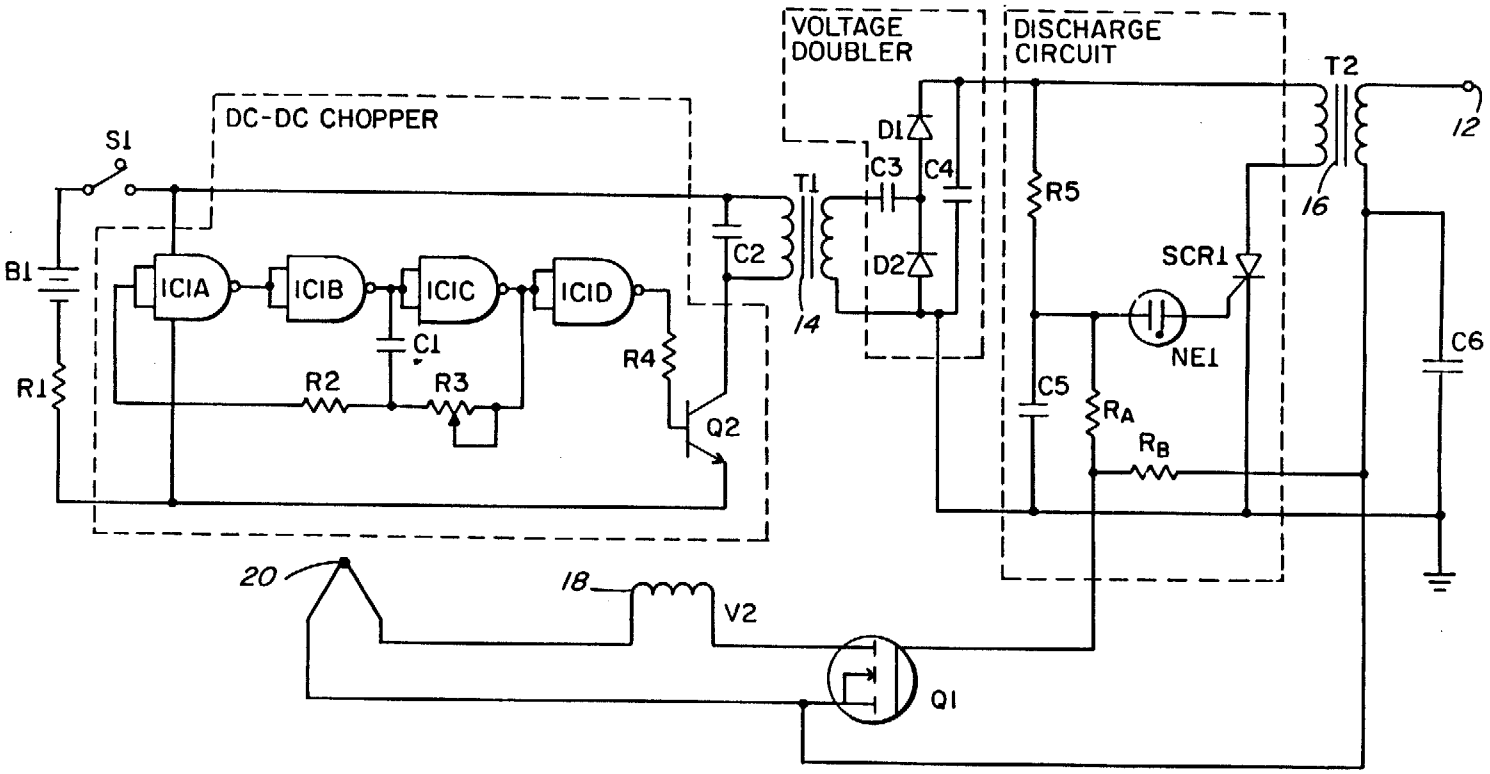
FIG. 1 is an electrical schematic diagram of the electronic ignition circuitry of a system embodying this invention.

The electronic ignition circuitry of a system embodying this invention is shown in FIG. 1. It includes a three volt D size battery B1 in series with a resistor R1. R1 is used for diagnostic current sensing and is not needed for the system to function. The three volt output from that battery is stepped up to about 10 kilovolts at an output 12. The output 12 is connected to a spark gap to ignite a pilot flame. When the switch S1 is closed, the three volt output from the battery B1 is applied across a set of NAND gates IC1A, IC1B, IC1C and IC1D which form a square wave oscillator. The capacitor C1, resistor R2 and variable resistor R3 control the timing of that oscillator. Its output is applied through a resistor R4 to a transistor Q2 which in turn draws current through the primary 14 of a step-up transformer T1.

The output of the transformer T1 is applied through a conventional voltage doubling circuit, comprising diodes D1 and D2 and the capacitor C3, to charge a capacitor C4. After a number of cycles of the input current through the transistor Q2, the charge on the capacitor C4 builds up to about 100 volts. Once that voltage is reached, if there is no flame, the capacitor C4 is rapidly discharged through the primary 16 of a second step-up transformer T2 by a silicon controlled rectifier SCR1. The transformer T2 increases the 100 volt input to a 10 kilovolt pulse at the output 12. The fast pulse through the output of the tranformer sees the capacitor C6 as a short circuit.

When the transformer T1 initially begins to charge the capacitor C4, the transformer output is seen as a short circuit. With a conventional transformer, this would result in a large current drain through the primary 14. However, the transformer T1 is designed to have a significant leakage reactance. The leakage flux, which amounts to a substantial portion of the total flux through the transformer, acts to limit the output current into the capacitor C4 and thus limit the input current. The amount of leakage reactance determines the desired capacitor charging rate and is physically obtained through the magnetic shunting effect of a gap between the center legs of the transformers' cores. The primary and secondary coils are wound on separate bobbins on the outer legs of the core.

Without the high leakage reactance of the transformer, the current in the output might alternatively have been limited by a resistor. However, in such an arrangement a significant amount of energy would have been lost by the resistor as heat. The current through the primary 14 which drives the leakage flux, on the other hand, is seen primarily as magnetizing current and that current is returned back through the primary to the tank circuit capacitor C2 as the transformer relaxes between pulses. The power stored on the capacitor is thereafter used to provide the magnetizing current in a subsequent input of current to the transformer.

It can be seen that, where a resistor network would convert the power to heat and thus lose that power, the transformer having leakage reactance and a tank circuit saves a substantial amount of that energy and returns it in subsequent cycles.

The silicon controlled rectifier SCR1 is gated "on" only once the voltage on capacitor C4 has reached 100 volts and only if the pilot gas has not yet been ignited. Once the pilot is ignited, power can be conserved by leaving the charge on the capacitor C4 so that the input circuit sees an open circuit. To that end, SCR1 is gated on through a voltage divider circuit comprising resistors R5, RA and RB which are in series with the spark gap at output 12. When there is no flame at the spark gap, the voltage divider network sees an open circuit at the output 12. Thus the current flow is minimal and the small capacitor C5 is charged to about the same voltage as the capacitor C4. Once capacitor C5 is charged to approximately 100 volts, the neon bulb NE1 conducts to gate SCR1 "on" and cause the capacitor C4 to discharge throught the primary 16 of the transformer T2.

Once the pilot is ignited, the flame itself conducts somewhat and there is no longer an open circuit at the output 12. Thus, there is a small amount of current flow through the resistors R5, RA and RB. Because resistor R5 is a large resistor, the charge across capacitor C5 is significantly reduced to about 60 volts even when capacitor C4 is fully charged. Thus, the neon bulb NE1 never gates SCR1 on.

The voltage drop across resistor RB also serves to gate an FET Q1 "on" and thus enable a main gas valve circuit. Current through the coil 18 of that gas valve is provided by a thermopile 20 which is heated by the pilot flame. The FET Q1 prevents the main gas valve from remaining "on" after a flame is extinguished but while the thermopile is still hot.

The circuit of FIG. 1 includes two flame sensors which must both sense a flame in order for the normally closed valve V2 to be opened. The thermopile 20 only generates current through the coil 18 if it is sufficiently hot due to a flame. However, it does take some time for the thermopile to cool once the flame is extinguished. The current sensor including resistor RB, on the other hand, provides a near instantaneous indication that the flame has been extinguished. Thus, the valve V2 is driven by the heat of the pilot flame and is enabled by the electrical conductance of the flame.

Figure 2:
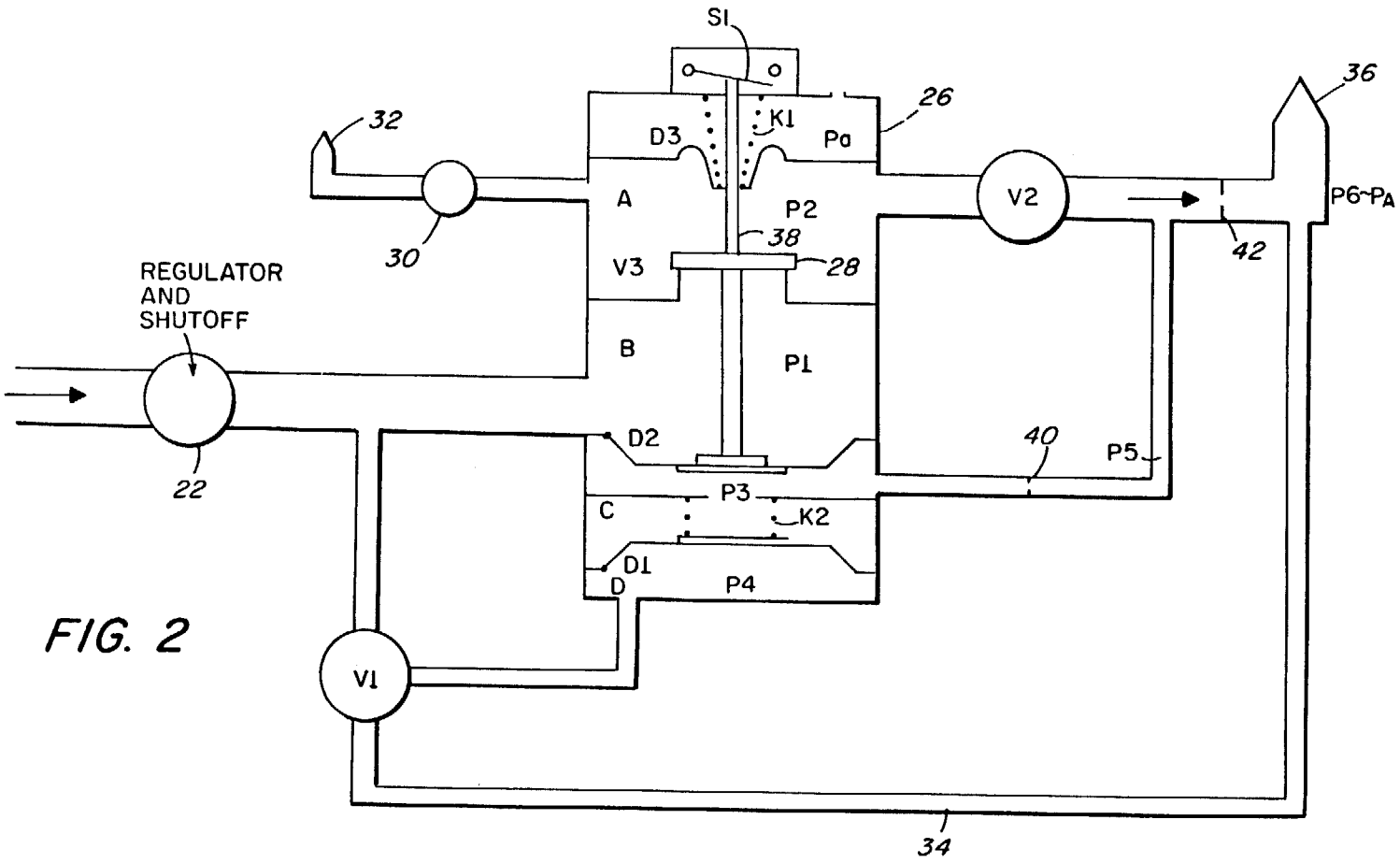
FIG. 2 is a schematic diagram of the valving mechanisms of a system embodying this invention and, in particular, of a safety valve mechanism.

The gas control valves of the system are shown in FIG. 2. A conventional regulator and manual shut-off valve 22 is provided at the gas inlet 24. The gas is applied directly to an input chamber B of a safety valve 26. A valve element 28 between the input chamber B and an output chamber A is normally closed by a spring K1 and the gas pressure across a diaphragm D2 as will be discribed below. Opening of the valve element 28 allows gas at line pressure to flow into the output chamber A and then through a regulator 30 and a pilot nozzle 32. Gas flow to the main burner 34 is blocked by a valve V2. As discussed above, the valve V2 is not turned on until a thermopile 20 is heated by a pilot flame and the pilot flame is also sensed through the resistor RB. The switch S1 at the ignition circuit battery supply B1 is closed by operation of the safety valve mechanism.

A chamber D is normally vented through a valve V1, a gas vent 34 and the main burner. When vented, the pressure P4 in chamber D is at about ambient. When the burner is to be turned on, the thermostatically controlled valve V1 connects the chamber D to the gas inlet. This causes the pressure P4 in chamber D to rise to line pressure. That pressure acts through a diaphragm D1 against a weak spring K2 to increase the pressure in a control volume C to near line pressure. The pressure P3 would initially have been at about ambient. With this increased pressure P3 in chamber C, the pressure differential across the diaphragm D2 no longer holds the valve element 28 closed. The valve opens and gas flows through chamber A to the pilot nozzle 32. When the valve opens, the pressure in chamber A is increased but the upward action on the valve rod 38 is maintained by the pressure differential across the diaphragm D3 which is exposed on its opposite side to ambient pressure.

The chamber C is vented through a time delay orifice 40 to a conduit downstream of main valve V2 but upstream from an orifice 42. With the valve V2 closed, the pressure P5 between the orifices 40 and 42 is at about ambient. Thus, the gas in chamber C, at a pressure P3 which is near line pressure, is vented through the time delay orifice 40. Due to the orifice, however, and the movement of diaphragm D1, the pressure in chamber C remains high and holds the valve element 28 open. If, within a time delay determined by the orifice 40, the pilot is ignited, the valve V2 is opened by the ignition circuit of FIG. 1. At that time, the orifice 42 provides a pressure drop such that an increased pressure is seen downstream of the orifice 40. That increased pressure, seen in chamber C, is sufficient to hold the valve element 28 open. Therefore, gas continues to flow through chamber B and chamber A and through both the pilot nozzle 32 and the main burner 36.

If the pilot fails to ignite and the valve V2 is not opened after a predetermined time delay, the gas in chamber C is sufficiently vented that the diaphragm D1 bottoms out and the pressure P3 begins to approach ambient. The valve mechanism 28 then closes. Thus, further gas flow to the pilot and main burner are precluded.

If the diaphragm D1 should bottom out and the valve element 28 has as a result closed, the line pressure through valve V1 continues to hold the diaphragm D1 at its end position so that the pressure in chamber C cannot be increased. The valve 28 remains closed until chamber D is vented through valve V1 and the diaphragm is returned to its lower position by the light spring K2. Thereafter, the chamber D can be recharged by the thermostatically controlled valve V1 to line pressure to again open the safety valve and initiate a new ignition trial.

Once valve V1 is closed due to sufficient heat, chamber D is vented to atmosphere and brings the pressure in chamber C to atmosphere to close the valve element 28.

It can be noted in the system of FIG. 2 that two normally closed valves are provided between the gas inlet 24 and the main burner 36. This is a safety feature which assures positive turn-off of the gas to the main burner except under proper conditions.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. A gas control in a gas burning system comprising a safety valve in series with a main gas valve and a pilot nozzle, the safety valve comprising a normally closed valve element for preventing gas flow to the main gas valve, a control chamber, means for increasing the pressure in the control chamber and valve control means responsive to increased pressure in the control chamber to open the valve element, the gas control further including a time delay orifice for venting the control chamber and flame responsive means for opening the main gas valve and terminating venting of the control chamber through the time delay orifice when a flame is sensed such that the safety valve closes after a predetermined delay if no flame is sensed.

2. A gas control as claimed in claim 1 further comprising an input chamber normally closed by the valve element, wherein the valve control means is driven by a pressure differential between the input chamber and the control chamber, the means for increasing the pressure in the control chamber comprising a diaphragm which has one face exposed to the control chamber and an opposite face exposed to line pressure through a thermostatically controlled valve.

3. A gas control as claimed in claim 1 wherein the safety valve, when opened, closes a switch which connects an electrical supply to an ignition circuit.

4. A gas control as claimed in claim 1 further comprising an input chamber connected to a supply of gas such that a line pressure is established therein and having an outpout normally closed by the valve element, wherein the valve control means is driven by a pressure differential between the input chamber and the control chamber across a diaphragm, and the valve element is actuated by the diaphragm.

5. A gas control as claimed in claim 4 wherein the output of the input chamber is coupled to an outlet chamber and the valve member is further coupled to a diaphragm between the outlet chamber and ambient pressure.

6. A gas control as claimed in claim 4 wherein the pressure in the control chamber is established through a diaphragm which is exposed to line pressure through as thermostatically controlled valve.

7. A gas control as claimed in claim 4 wherein the main gas valve is opened only when a pilot flame is sensed and the means for venting the gas which holds the valve open vents to a line between the main gas valve and a burner assembly such that the gas is not vented once the main gas valve is opened.

8. An gas control system as claimed in claim 1 wherein the main gas valve is open only when a pilot flame is sensed and the means for venting the gas which holds the valve open vents to a line between the main gas valve and a burner assembly such that the gas is not vented once the main gas valve is opened.

9. A gas control in a gas burning system comprising a safety valve in series with a main gas valve and with a pilot nozzle, the safety valve limiting the flow of gas to each of the main gas valve and the pilot nozzle and comprising:

an input chamber for receiving gas;

a normally closed valve element for preventing gas flow from the input chamber to the main gas valve and to the pilot nozzle;

a control chamber;

valve control means responsive to a pressure differential between the control chamber and the input chamber to open the valve element with increased pressure in the control chamber;

a thermostatically controlled valve for increasing the pressure in the control chamber;

a time delay orifice for venting the control chamber; and means for venting the control chamber through the time delay orifice until a flame is sensed such that the pressure in the control chasmber is reduced and the valve element is closed after a predetermined delay if no flame is sensed.

* * * * *

UNITED STATES PATENT AND TRADEMARK OFFICE

CERTIFICATE OF CORRECTION

PATENT NO. : 4,717,333

DATED : January 5, 1988

INVENTOR(S) : Forest J. Carignan

It is certified that error appears in the above—identified patent and that said Letters Patent is hereby corrected as shown below:

In column 1, after the title, insert:

---Government Support

The government has rights in this invention pursuant to subcontract number 7381 under contract W-7405-ENG-26 awarded by the U.S. Department of Energy---.

Signed and Sealed this

Fifth Day of July, 1988

*Attest:*

*Attesting Officer*

DONALD J. QUIGG

*Commissioner of Patents and Trademarks*